United States Patent [19]

Jackson

[11] 4,167,476

[45] Sep. 11, 1979

[54] BULK ARTICLE SORTING SYSTEM

[75] Inventor: Dale H. Jackson, Bethlehem, Pa.

[73] Assignee: Harris Corporation, Cleveland, Ohio

[21] Appl. No.: 867,198

[22] Filed: Jan. 5, 1978

Related U.S. Application Data

[63] Continuation-in-part of Ser. No. 794,667, May 6, 1977, abandoned.

[51] Int. Cl.[2] ..... B07C 9/00

[52] U.S. Cl. ..... 209/3.3; 209/551; 209/900; 93/93 C; 270/58; 271/213

[58] Field of Search ..... 209/73, 74 R, 74 M, 209/DIG. 1, 551, 900, 3.1, 3.2, 3.3; 93/93 R, 93 M, 93 C, 93 DP; 271/213, 263; 270/54, 58; 53/54; 100/4; 198/340, 356, 358; 214/6 TS

[56] References Cited

U.S. PATENT DOCUMENTS

| | | | |
|---|---|---|---|
| 2,702,189 | 2/1955 | Zugel et al. | 271/263 X |
| 3,652,828 | 3/1972 | Sather et al. | 209/DIG. 1 |
| 4,014,784 | 3/1977 | Dunlap | 209/73 |

*Primary Examiner*—Joseph J. Rolla

[57] ABSTRACT

Articles to be mailed under bulk mail rates are stacked in accordance with their zip code. Articles with identical zip codes are bundled in numbers according to postal regulation minimum and maximum limits. When the number of articles in a zip code group is less than the postal minimum for a bundle, the zip code group is diverted for special handling. The system is capable of identifying consecutive zip code groups of articles each of which are under the postal minimum for a stack and bundling these together in the main stream as long as together the consecutive groups are over the minimum.

5 Claims, 5 Drawing Figures

BULK ARTICLE SORTING SYSTEM

CROSS-REFERENCE TO RELATED APPLICATION

This application is a continuation-in-part of application Ser. No. 794,667 filed May 6, 1977, now abandoned.

BACKGROUND OF THE INVENTION

The present invention relates generally to the sorting of bulk quantities of articles labeled for various destinations and, more particularly, to the sorting of mail by zip code into segregated groups complying with postal regulations to qualify the group for bulk postal rates.

Bulk mailing of magazines, newspapers, advertisements, etc. has economic benefits. Specifically, the postal service allows preferential treatment to bulk mail if certain regulations are complied with, namely, regarding the size and numbers of articles in a group.

Systems have been developed and are in use in which the bulk mail articles are segregated by zip code of the party to whom the article is mailed. The groups of like zip codes are stacked and bound together in a bundle or bundles to be delivered to a postal distribution center in the particular zip code area.

One particular regulation of the postal service concerns the quantity of articles in a bundle directed to any one zip code area. The regulation imposes a minimum and maximum on the number of articles in the bundle. Present systems sense and segregate the quantity of articles for each zip code area to comply with bundle sizes, i.e., minimum and maximum. Further, such systems direct all zip code groups of less than minimum quantity out of the main stream of articles for special handling. The special handling consists of manual manipulation of the articles such as stacking, etc.

Depending on the particular user, presently known systems may be perfectly acceptable. For example, if the user has large quantities of articles to all zip codes, such user does not very often encounter zip code groups of articles below the minimums set by the postal service regulations. Accordingly, relatively few groups are diverted out of the main stream and the extra cost involved for special handling of the diverted group is absorbed relatively easily.

The state of the art is not completely satisfactory for the user who has a large quantity of zip code groups of a number less than the minimum. For such a user, the quantities of articles diverted out of the main stream and requiring manual handling is excessive.

SUMMARY OF THE INVENTION

In accordance with the present invention, when consecutive zip code groups, each being of less than minimum size (however, which together total more than minimum size) are encountered, these consecutive groups are directed to a stacker of the system and are not diverted. As a result, the stacker forms a mixed bundle or stack. This mixed bundle is tracked by the system and is marked and sorted, accordingly downstream of the stacker.

As a result of this capability, the system of the present invention is particularly useful where many small zip code groups are encountered. Known systems divert all such small zip code groups for manual handling whereas in the present system, consecutive small zip groups are automatically stacked in the main stacker as a mixed stack and tracked through the system. Further, the system of the present invention does operate to divert small zip code groups which are not of a minimum size and which are located between two code groups of more than minimum size. Such diverted groups can be manually handled and reintroduced into the system downstream of the main stacker.

More specifically, in accordance with the present invention, computer flexibility is preferably used to process and sort mail with minimum manual handling of small zip code groups. In the present invention, articles are consecutively labeled as they are conveyed past a labeling station. The labels are processed in zip code groups. A microcomputer or control center is used in the system and receives information from a label scanner in advance of the labels being applied to the articles. In the preferred mode, the information received includes counts of labels in a group and the end of a zip code group. This enables the count of the number of articles in a group to be compared with postal minimum bundle size. Further, the number of articles in consecutive small zip code groups can be manipulated in the microcomputer to combine less than minimum groups. The microcomputer controls the divert function and the stacker so that consecutive small zip code groups each of a number less than the postal minimum but together greater are stacked in a mixed bundle. Small zip code groups located between large groups will be diverted.

BRIEF DESCRIPTION OF THE DRAWINGS

Further advantages and features of the present invention will be apparent to those skilled in the art to which the present invention relates upon a reading of the following specification with reference to the accompanying drawings in which.

DESCRIPTION OF A PREFERRED EMBODIMENT

The present invention concerns the handling of articles to be mailed in bundles according to zip codes. The postal service allows special rates for bulk mail when certain guidelines are complied with. In accordance with the present invention, the articles are divided into groups, according to the zip code, and bundled with between articles in each bundle between maximum and minimum limits. Whenever the number of articles of like zip codes is less than the minimum, the group is diverted from the main stream for special bundling. This diversion occurs unless consecutive zip code groups are each of a number less than the minimum but together are of a number in excess of the minimum; in which case the consecutive groups are stacked together and remain in the main stream.

Figure 1:
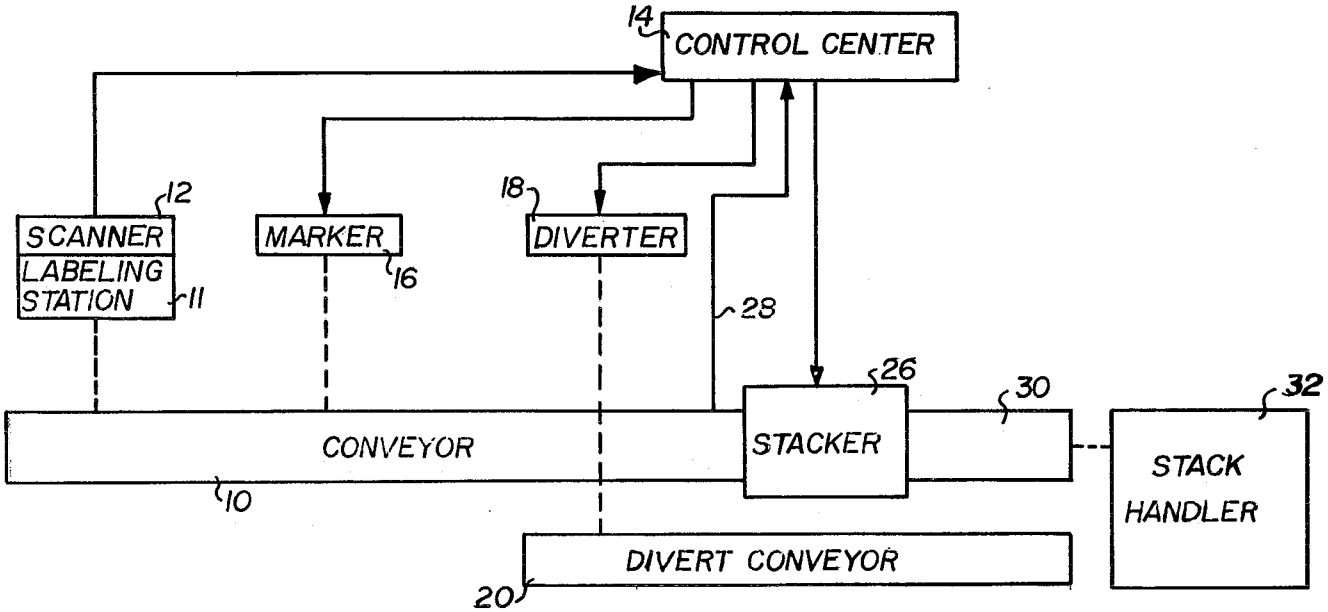
FIG. 1 is a block diagram illustrating the basic elements of a system embodying the present invention.

The system of the present invention is illustrated in FIG. 1 in block diagram form. As shown, the system includes a conveyor 10 for transporting articles in sequence past various stations in the system. The articles which are transported by the conveyor 10 are provided with mailing labels, with the address of the intended recipient thereon, at a labeling station 11. The labels are preprinted and arranged in zip code groups to be fed consecutively to the articles. A scanner 12 at the labeling station scans the labels while in the label queue in advance of application of the label to the article. The information read by the scanner 12 includes a count of each label and an end of zip code signal and is transferred to a control center 14. The information obtained with the scanner 12 allows the control center 14 to determine the number of articles in each zip code group.

A marker 16 is provided along the conveyor 10 for the purpose of placing a readily identifiable mark on one article of each group to aid in handling and delivery of the group. The marker 16 is operated under the instruction of the control center 14.

Whenever the control center 14 determines that the number of articles in a zip code group is less than a preselected minimum, a signal is sent to a diverter 18 causing the particular group to be directed off the conveyor 10 and onto a divert conveyor 20. There are occasions when a group of articles less than the minimum is not diverted. One such occasion is when there exists consecutive zip code groups individually of less than a minimum number of articles but which together total more than the minimum. The control center 14, through the scanner 12, has the ability to look at the mailing labels far enough in advance to determine when such consecutive zip code groups of less than minimum occur and to store such information. In such cases, the control center 14 does not instruct the diverter 18 to direct the groups of articles off the conveyor, but rather the consecutive groups are bundled together with an appropriate marking applied by the marker 16 indicating a mixed stack or bundle.

When the control center 14 instructs the diverter 18 to direct articles off the conveyor 10, these articles are removed, by appropriate mechanical mechanisms, to the divert conveyor 20. Preferably, a gate mechanism 19 (FIG. 3) moves to a divert position to direct the articles to divert conveyor 20. The diverted articles are intended to be specially handled, as by manual manipulation, in order to be prepared for eventual delivery.

If a zip code group of articles is not diverted, the conveyor 10 continues to move the articles to a stacker 26. The stacker 26, which is operated through instructions from the control center 14, positions the articles one on top of another to form stacks or bundles. The amount of articles in any one bundle is dictated by the control center 14. The stacker 26 is also instructed by the control center 14 to alternate the position of the articles, i.e., turning articles 180 degrees, for the purpose of compensating for any unevenness in the bundle due to varying thickness in a particular article, eg. magazine, or the like.

As indicated at 28, the control center 14 receives information from conveyor 20 as to the location of conveyor spaces with respect to a known point. The control center correlates this information with that received from scanner 12 to track each group of articles so that appropriate commands can be given at the correct time to marker 16 and stacker 26.

After forming the bundles, stacker 26 directs them onto a second conveyor 30. Conveyor 30 moves the articles, now in bundles, to a stack handler 32. The stack handler 32 may include tyers, baggers and other associated mechanisms intended to effect a more orderly distribution of the bulk mail. The particular equipment utilized in handling the bundles exiting from the conveyor 30 is intended to segregate the stacked articles such that all bundles of like zip codes are collected and deposited at separate stations, e.g. mail bags, for delivery. Bundles of mixed zip code groups are formed, perhaps manually, from the articles on divert conveyor 20 and are likewise collected and deposited at a station for further handling in accordance with postal service regulations.

A particular uniqueness attributable to this invention is the ability to pass consecutive zip code groups each of less than minimum sizes without the necessity of these groups being diverted from the main stacker in the system.

Figure 2:
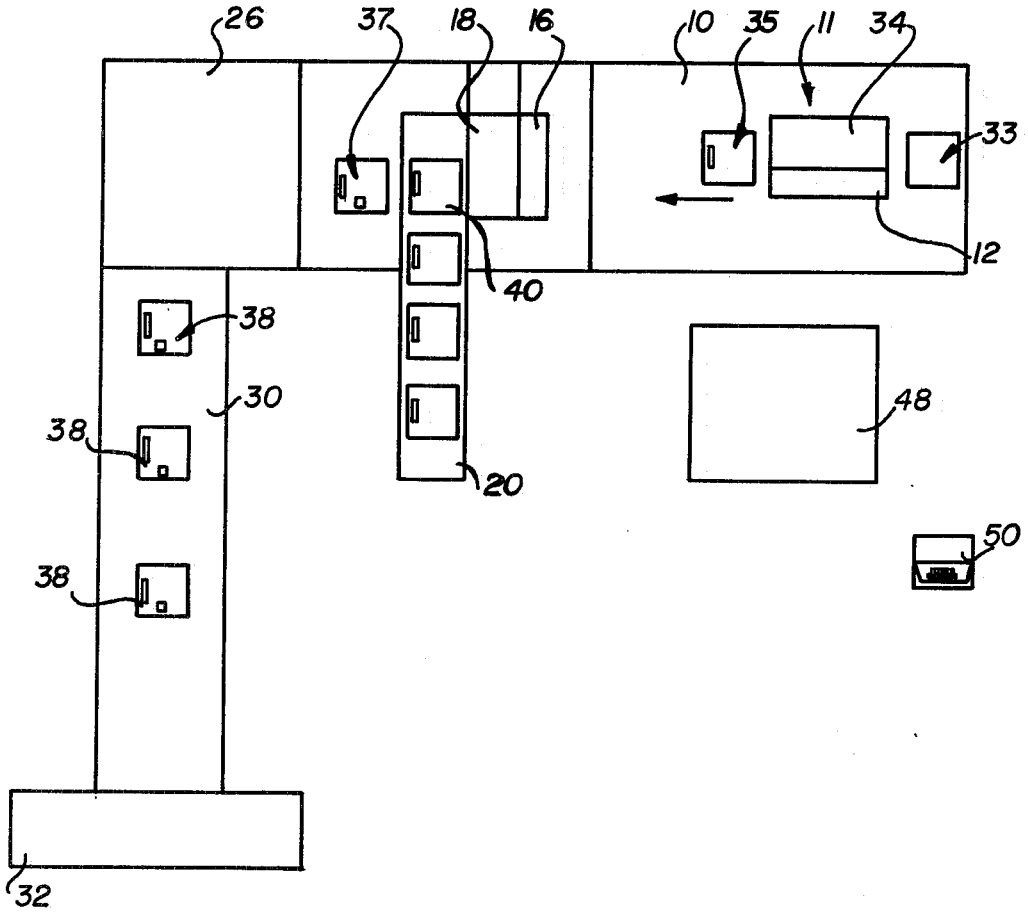
FIG. 2 is a top plan schematic view of a system embodying the present invention.
Figure 3:
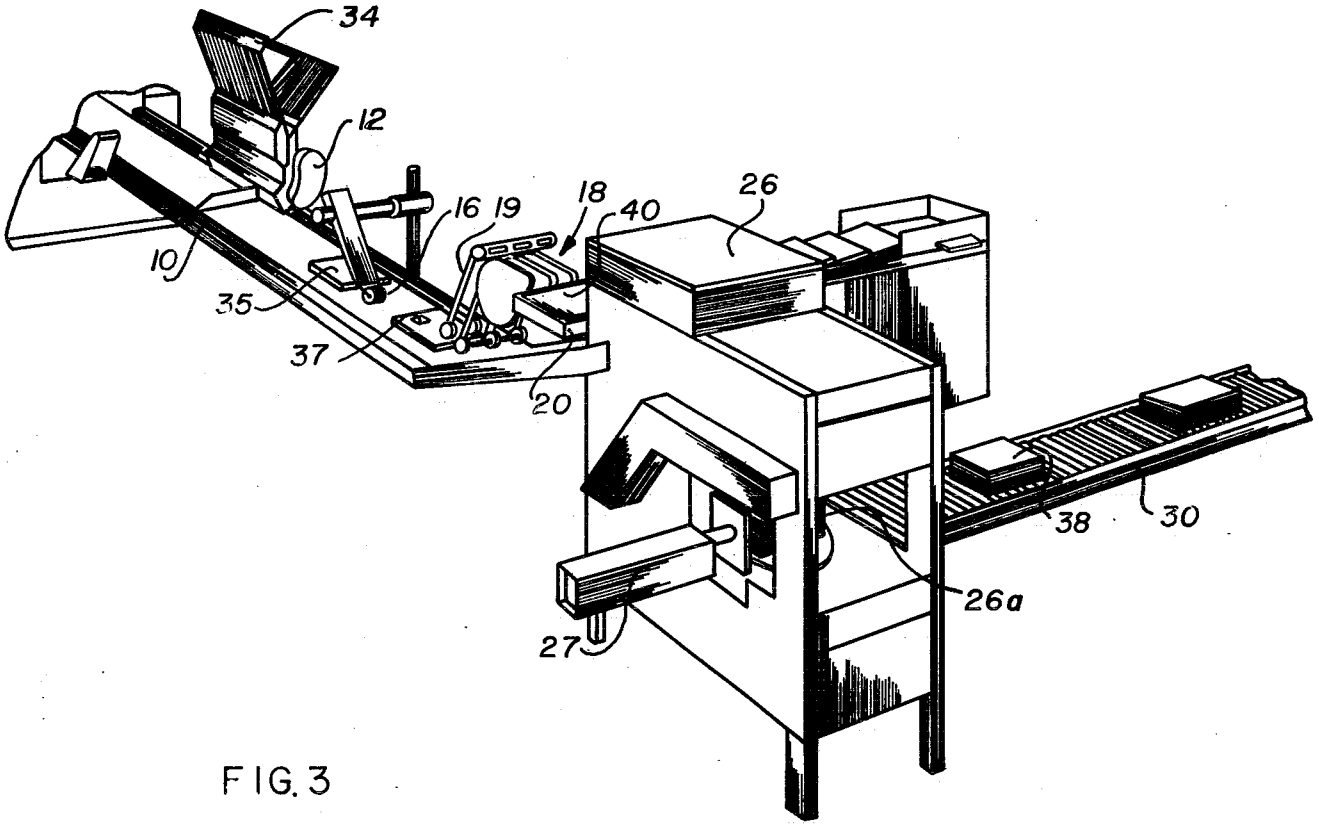
FIG. 3 is a perspective view of a system embodying the present invention.

FIGS. 2 and 3 illustrates the present invention in greater detail. An article, indicated generally at 33 (FIG. 2), to be mailed is delivered onto an infeed end of the first conveyor 10 by appropriate means (not shown). When the first conveyor 10 is operating, articles are transported to the left (as shown in the figure) to labeling station 11 which includes a mailhead 34. The mailhead 34 applies preprinted mailing labels to the articles, individually, as they pass.

The mailhead 34 is provided with a sensor 35 to indicate the presence of an article on the conveyor 10 at the mailhead. The purpose of this sensor is to insure that the mailhead does not apply a label when an article is not present. Signals from the sensor are sent to the control center 14 for use in adjusting the system for proper relationship between components in view of any missing articles.

The mailing labels, in addition to the name, address and zip code of the intended recipient having special markings on the last label including an end of zip code signal and a marking indicating a five digit change in zip code for the next group. The system utilizes these special markings to direct the operations of the system according to the preprogrammed modes of operation of the control center 14.

As an article, indicated generally at 33 (FIG. 2), now with mailing label attached, continues to move (to the left as shown), along the first conveyor 10, the marker 16 is the next portion of the system which affects it. Briefly, an article indicated generally at 37, which is not to be diverted and which is to be on the top of a stack is marked to indicate further handling instructions. The marker 16 is controlled by signals from the control center 14 to apply, upon command, gummed labels to articles which are to be on the top of bundles indicating either "direct" for a bundle of articles with identical zip codes, or "mixed" for a bundle of articles with different zip codes. Directly after, and adjacent, the marker 16 is the diverter 18. Articles which are not to be diverted are not affected by the diverter and continue on conveyor 10 to stacker 26.

As the undiverted articles reach the end of conveyor 10, they are delivered to stacker 26. In stacker 26, the articles are placed one on top of another, preferably alternating the position 180 degrees every so often, to form bundles. The stacker may be of any conventional design. Preferably, it has a turntable 26a (FIG. 3) which is rotatable to alternate the position of articles in a stack and an ejector mechanism 27 (FIG. 3) for pushing complete stacks from the turntable onto a second conveyor 30. The second conveyor 30 transports the bundles 38 to the stack handler 32.

Returning to the diverted articles, once the diverter 18 has removed an article, indicated generally at 40, from the first conveyor 10, this article 40 is placed onto the direct conveyor 20. The diverted articles are transported by the divert conveyor 20 to a location where they can be handled manually to prepare them for mailing. It will be appreciated however, that the number of such diverted articles which require manual handling is much less than previously because of the mixed bundles formed in accordance with the present invention.

The control center 14 of the system, preferably comprises a microcomputer 48 and a keyboard 50 (FIG. 2). In this instance, the term microcomputer is intended to mean a programmed logic and memory system provided for a particular purpose, i.e., to control the mail sorting system. The keyboard 50 allows an operator to transmit alternate control signals and generally monitor the system.

The microcomputer 48 is specially programmed to receive inputs, store information, perform various calculations, and transmit control signals to the remaining components of the system. More precisely, the microcomputer 48 receives input from the scanner 12 and transmit control signals to the marker 16, stacker 26, diverter 18, conveyor 10, and the stack handler 32. Preferably, microcomputer 48 is a Model 1103 microcomputer manufactured by Digital Equipment Corporation and keyboard 50 is a Model RTO2 keypad terminal manufactured by the same company.

The received information is utilized by the microcomputer 48 to calculate the quantities of articles in each individual zip code group. In addition, as noted above, the microcomputer has access to mailing label information considerably in advance of the time commands must be provided to the marker, stacker etc. In fact, it is possible to store quantities from two or more zip code groups from the mailing labels in the microcomputer at any instant in time. These quantities of articles are then compared to preprogrammed minimums and maximums corresponding to postal regulations as noted above. The results of these comparisons are used to divert articles as required, and to form mixed and normal bundles.

The microcomputer 48 performs the control functions to effect the bundling of articles according to postal regulations, the diverting of articles of groups having less than minimum quantities and the bundling of consecutive zip code groups identified by the microcomputer.

As noted above, the postal service provides minimum and maximum numbers of articles for zip code groups depending on which class of bulk mail is to be met. These minimums and maximums are set for any particular run by an operator at the keyboard 50. The speed at which the conveyors transport articles, particularly the divert conveyor 20, can be adjusted by appropriate operator intervention at the keyboard 50.

The microcomputer 48 is programmed so as to render the system self-explanatory to the operator. Upon commencing operation of the system, the microcomputer 48 through a display at the keyboard 50 requests the necessary parameters for operation from the operator. The parameters include minimum and maximum number of articles in bundles, rate of compensation of bundles, odd stack counts and others. Once the system is operating, the display at the keyboard 40 keeps the operator informed of the status while immediately indicating any system malfunction.

Figure 4:
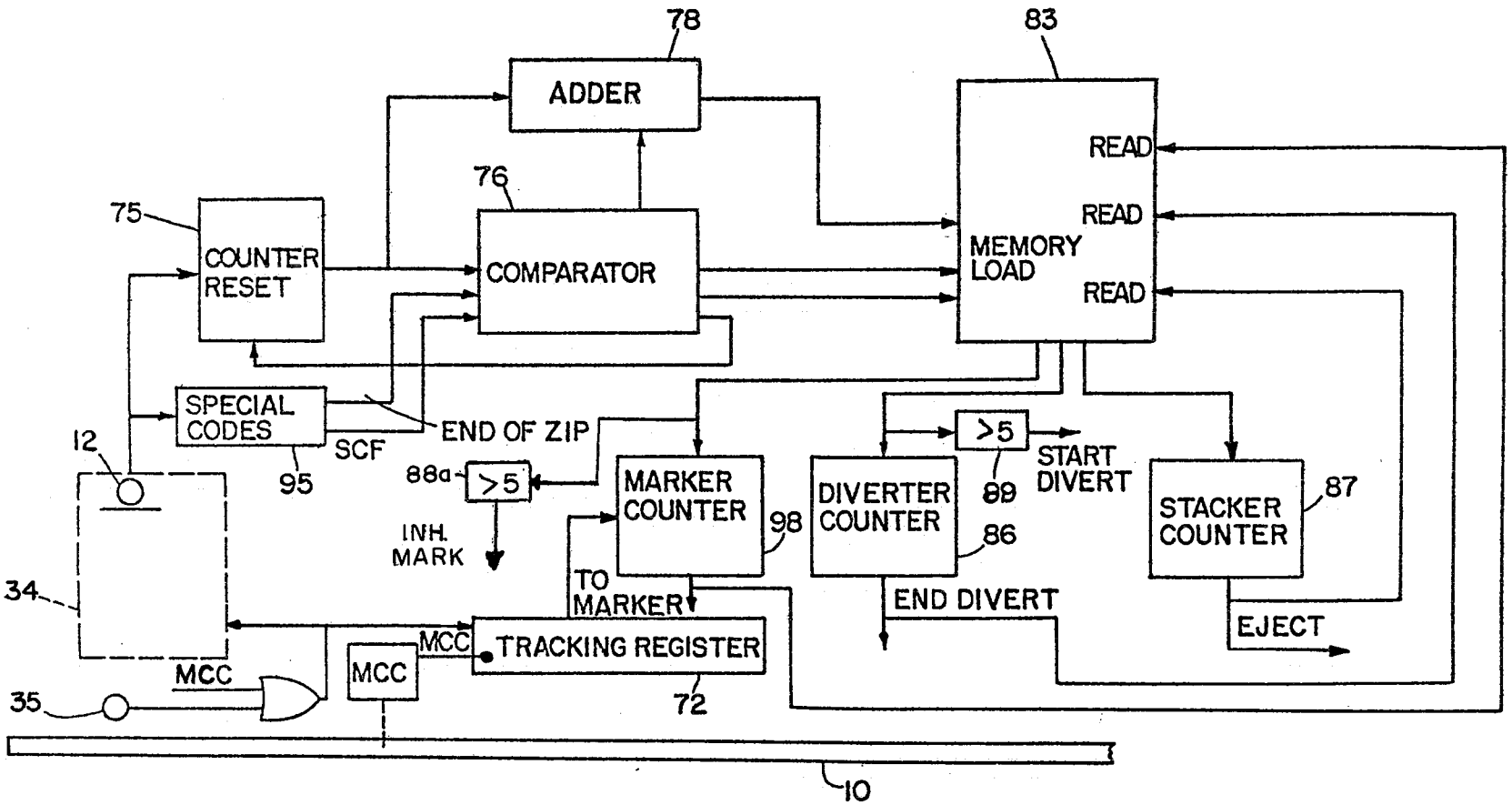
FIG. 4 is a flow diagram of the major elements of a properly programmed microcomputer serving as the control center for a system embodying the present invention.
Figure 5:
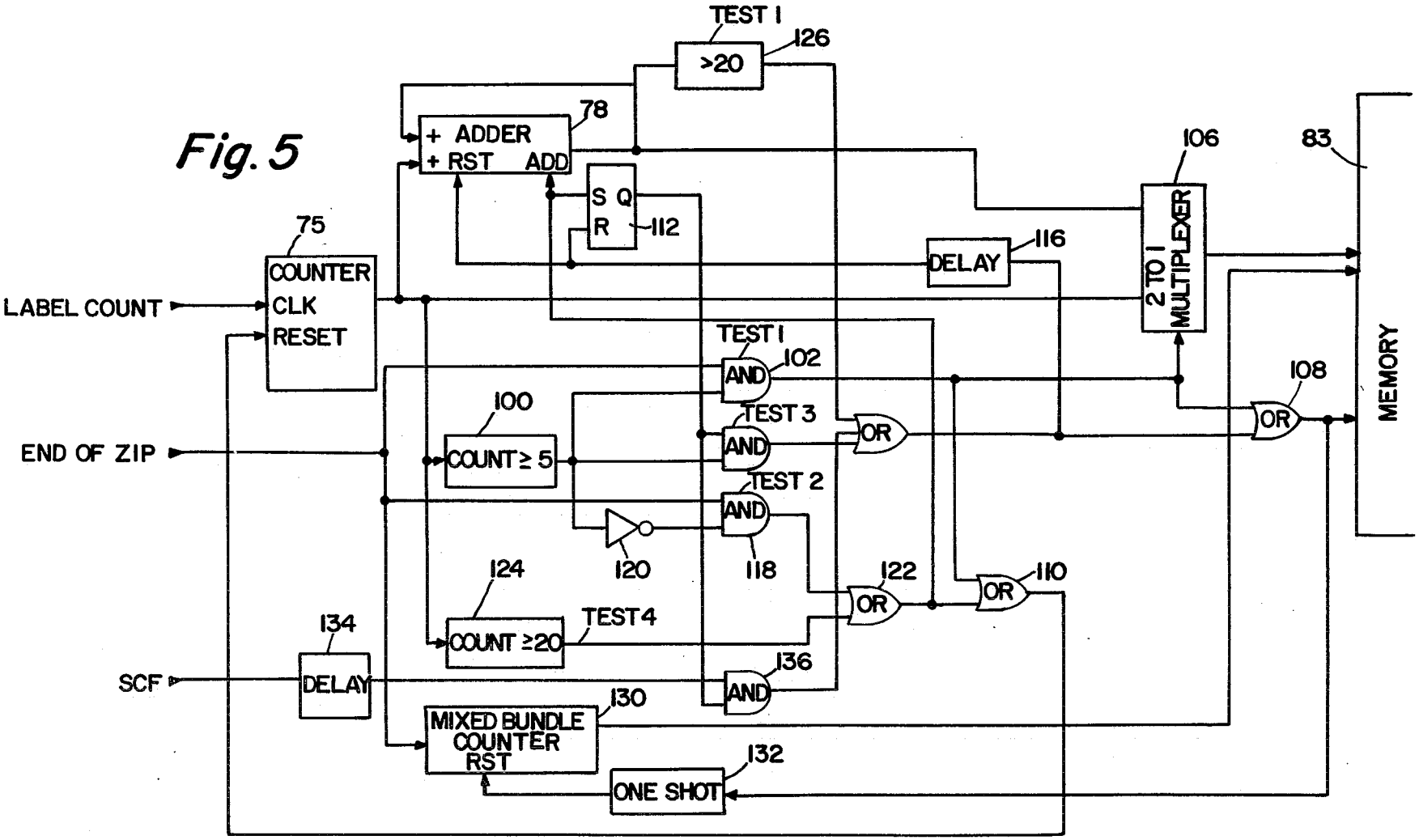
FIG. 5 is a detailed showing of the control system in logic form.

Zip Group Counter (ref. FIGS. 4 and 5)

The operation of the control center for bundling by zip code when the group is over the minimum and to divert the articles when the group is under minimum is known, including the division of a group over the maximum limits into acceptable bundles. In such known systems, the scanner 12 scans the labels in a queue in the mailhead to count the labels moving to the application point and to send the count signals to a counter 75 for counting the labels. The counter counts are interpreted as counts for labels of one group until the scanner 12 senses an end of zip code designation on the last label of a group. After each incrementing of the count, a check is made by the comparator to determine if the count is under the maximum limits; if so, the counter continues to count. If a maximum is reached before an end of zip code group is sensed, the comparator will store that maximum number until it is determined there are sufficient additional articles in the group (no intervening end of zip signal from scanner 12) to form another stack having more than a minimum stack count. If this is the case, then the comparator will transfer the maximum bundle count to a memory 83 to be stored therein for use in controlling operation of the stacker. If, however, the number of remaining articles in the group is less than the minimum stack count, i.e. an end of zip signal is received before the count for the remainder reaches the minimum stack count, the comparator will add the count for the remainder to the previously stored maximum count, and then store the combined count in the memory 83.

If an end of zip code signal were obtained in the known machine prior to reaching the minimum count in the counter, the count number would be entered into the memory 83.

Also, in known systems the successive counts as stored in memory are read from memory to control the stacking and diverting operations. The stored numbers are read sequentially into respective counters and the counts are counted down in a diverter count circuit 86 and a stacker count circuit 87 by signals from the tracking register 72.

The sensor 84 senses each time an article is in position to have a label applied, and then enables operation of the mailhead 34. Each time the sensor senses an article, its signal to the mailhead is also applied to the serial input of the tracking register 72, which may be a multistage shift register. The contents of register 72 are shifted from left to right (as seen in FIG. 4) by the machine cycle clock. The machine cycle clock (MCC) is derived from a sensor 85 which provides a pulse for each cycle of operation of the apparatus. The contents of the shift register will thus shift once for each article space arriving at the mailhead 34. The sensor signals which are loaded into the register will therefore move along the register in synchronism with the movement of the article spaces along the conveyor. These signals will arrive at selected taps of the register concurrently with the arrival of the article spaces at corresponding positions along the conveyor. The signal from the appropriate taps of tracking register 72 are utilized to count down counters 86 and 87 each time a space arrives at the divert mechanism or stacker with an article in the space. No count down will occur for spaces containing no article because no signal was loaded from scanner 12 into the register for that article space. This accommodates spaces with no articles as may occur during operation.

When the divert or stacker counter is counted down to zero, a signal to the corresponding station will be given and a new count requested from the memory 83.

As shown in FIG. 4, the divert counter views the tracking shift register 72 earlier than the stacker counter since the machine cycle delay from the mailhead to the diverter is less than that for the stacker.

In operation, when a count is entered into the divert counter, a less than five circuit 88*a* determines if the new count is less than the minimum stack count (e.g. five). If so, it immediately signals the divert operation. When the count of less than five is completed the signal from the counter signals the end of divert. Both the stacker counter and divert counter count all bundle numbers. In the case of the stacker if the stacker memory gives an eject signal with no articles in the stacker it is of no consequence. In the case of the divert counter, the end of divert signal has no effect unless a divert operation was underway.

In accordance with the present invention, the count of a zip code group below minimum is stored in the adder 78 in response to the end of zip code signal. When entered into the adder, the count is tagged.

If the following count is less than minimum it is also added to the adder. The adder is continually checked to determine if the number in the adder is greater than the maximum. If the number exceeds maximum, the count in the adder will be transferred to memory 83. In the preferred embodiment, the maximum number is set by stacker capacity less the minimum group number, so that if the adder count goes above maximum it cannot go above stacker capacity (or postal regulation maximum if stacker capacity is greater than that of postal regulations).

In addition, a marker counter 98 is provided in accordance with the present invention. The marker counter operates in response to the flag for a mixed bundle (derived from memory) and a signal from an appropriate tap along tracking register 72 to apply a mixed bundle mark or label to the last article of the bundle. In the absence of a flag, the marker will apply a "direct" mark or label to the last article. A less than minimum circuit 88*a* will inhibit operation of the marker for groups to be diverted.

There is illustrated in FIG. 6 a more detailed schematic illustration of the contents of comparator 76, and which illustrates more specifically the relationship between counter 75, comparator 76, adder 78 and memory 83. The purpose of this circuitry is to accumulate counts indicating the size of the bundles which are to be assembled, to identify the bundles as mixed or unmixed, and to load these bundled counts (and a mixed-bundle flag) into memory 83 in the sequence in which they are to be assembled. The bundle counts and flag thus loaded into memory will be utilized in the manner previously described.

As described previously, counter 75 is incremented by each of the pulses provided by label scanner 12 so that the count contained within counter 75 will be incremented by one for each label delivered by the label head. This count is directed to the comparator 76, which tests the magnitude of this count continuously. This comparator performs a variety of tests in order to generate the bundle counts. Comparator 76 also responds to special code signals which are derived from scanner 12 by means of a code or mark detecting circuit 95. These special codes include an end of zone code and an SCF code indicating a five digit change in zip code for the next group. When an end of zip code is sensed, a single pulse will be provided on the end of zip input to comparator 76. Likewise, when a change in SCF code is sensed, a single pulse will be provided on the SCF input to comparator 76. In the ensuing description it will be presumed that the pulses occur sequentially. That is, any end of zip pulse will occur after the count pulse, and any SCF pulse will follow the corresponding end of zip pulse. Known techniques may be utilized to properly phase the pulses.

Before proceeding with a detailed description of this figure, a brief summary will be provided of those tests which are performed by comparator 76:

Test 1: For this test, comparator 76 monitors the contents of counter 75 to determined, when an end of zip pulse is received, whether the count is greater than or equal to the minimum stack count (e.g. five). In this event, comparator 76 will load the count contained within counter 75 directly into memory 83, and then reset counter 75.

Test 2: For this test, comparator 76 will monitor the contents of counter 75 to determine, when an end of zip pulse is received, whether a count of less than minimum stack count (e.g. five) is contained therein. In this event, the comparator will load the count then contained in counter 75 into adder 78, will set a tag associated with the adder so as to indicate that the adder is not empty, and then will reset the counter.

Test 3: For this test, the output of counter 75 is monitored to determine when the count contained therein exceeds the minimum count (regardless of whether an end of zip pulse is received). If, in this event, the tag associated with adder 78 indicates that the adder does include a partial count then the contents of the adder 78 will be loaded into memory, 83 and the adder (including the associated tag) will be reset.

Test 4: For this test, the output of counter 75 is monitored to determine when the count contained therein exceeds the maximum stack count, e.g. twenty (regardless of whether an end of zip pulse is received). In this event, the count of twenty will be loaded into adder 78, the tag associated with adder 78 will be set (so as to indicate that adder 78 includes a partial count) and counter 75 will be reset.

In addition to these four tests, adder 78 will also have a test associated therewith. For this test, the output of adder 78 will be monitored to determine when the adder count is greater than the maximum stack count, (twenty, in the illustrated embodiment). When this occurs, the contents of the adder will be loaded into memory 83, and the adder (including its associated tag) will be reset.

By performing these tests, acceptable bundle counts are generated and loaded into memory as the label head scans each label.

A comparator 100 is provided for monitoring the contents of counter 75 and for indicating when the count contained therein is greater than or equal to the minimum acceptable stack count of five. The results of this comparison are directly utilizined by two AND gates 102 and 104, which respectively indicate the status of tests 1 and 3. It will be noted that both of these tests require a determination as to whether the contents of counter 75 are greater than or equal to minimum stack count. AND gate 102 (test 1) is enabled by the output of comparator 100 whenever the contents of counter 75 are greater than or equal to the minimum stack count. When AND gate 102 is thus enabled, the end of zip pulse received at the input to comparator 76 will be enabled to pass through AND gate 102 so as to cause the loading of memory 83 with the contents of counter 75, and to also cause the resetting of counter 75. To this end, the output of AND gate 102 is directed to a two-to-one multiplexer 106, and controls the operation thereof. Two-to-one multiplexer 106 has two multi-bit inputs. The output of counter 75 represents one of these inputs, whereas the output of adder 78 represents the second of these inputs. Dependent upon the output of AND gate 102, either one or the other of these inputs will be connected to the output of multiplexer 106, and thus to the input of memory 83.

When the output of AND gate 102 is at a high logic level, indicating that the memory is to be loaded directly from counter 75, multiplexer 106 will connect the output of counter 75 to the input of memory 83. This high logic level pulse at the output of AND gate 102 is also routed to the LOAD input of memory 83 via an OR gate 108. Thus, a pulse occurring at the output of AND gate 102 will cause multiplexer 106 to connect counter 75 to memory 83, and will instruct memory 83 to load that number therein. The output of AND gate 102 is also directed back to the reset line of counter 75 via an OR gate 110.

AND gate 104 performs the third test, as defined above, by monitoring the output of comparator 100 and the output of a set/reset flip flop 112. Flip flop 112 is included to provide the tag which is to be associated with adder 78. If adder 78 contains a partial count, then the "Q" output of flip flop 112 will be at a high logic level. Otherwise, flip-flop 112 will be in a reset state. AND gate 104 determines when the count contained within counter 75 exceeds the minimum stack count when a partial count is stored within adder 78. In this event, the output of AND gate 104 will shift to a high logic level, thus providing a load signal to memory 83 by means of OR gates 114 and 108. Since the output of AND gate 102 will be at a low logic level, the control input to multiplexer 106 will also be at a low level. Thus, multiplexer 106 will at this time connect the output of adder 78 to the input of memory 83. The load command provided at the output of AND gate 104 will therefore cause memory 83 to load therein the count then contained within adder 78. The output of AND gate 104 will also reset adder 78 and the tag flip-flop 112 after a brief delay introduced by a delay circuit 116. This delay is included to insure that adequate time is available for the contents of adder 78 to be loaded into memory 83 prior to being reset.

The output of comparator 100 is also directed to a third AND gate 118 via an inverter 120. AND gate 118 indicates the status of test 2. Since the output of comparator 100 will remain at a low logic level until the minimum stack count is reached by counter 75, the output of inverter 120 will remain at a high logic level until then. AND gate 118 will thus be enabled to pass the end of zip pulse until a minimum stack count is reached. If the end of zip pulse occurs before the minimum stack count is reached by counter 75, then the output of AND gate 118 will go to a high logic level. This will trigger the storage of the count contained within counter 75 into adder 78 and will set the tag associated with adder 78. To this end, the output of AND gate 118 is directed through an OR gate 122 into the "ADD" input to adder 78, and also to the set input to tag flip flop 112. This will cause adder 78 to add the contents of counter 75 to whatever count is already contained therein. Thus, if adder 78 had already contained a partial count, then the end of zip signal gated by AND gate 118 and OR gate 122 will cause adder 78 to increment this partial count by the amount of the count contained within counter 75. This end of zip signal, as further gated by OR gate 110, will also produce a reset signal for resetting counter 75.

The output of counter 75 is also directed to another comparator 124 for determining the status of test 4. Comparator 124 will provide a high logic level output only when the contents of counter 75 are greater than or equal to the maximum stack count (twenty, in this embodiment). When this occurs, a load signal will be directed to adder 78 via OR gate 122, which will cause the contents of counter 75 (i.e., the maximum stack count) to be loaded therein. This signal will also cause counter 75 to be reset via OR gate 110. It will be noted that adder 78 will always be reset prior to this condition occurring, since comparator 100 will have caused the resetting of adder 78 via AND gate 104 (Test 3) before the maximum stack count may be reached.

In order to prevent the contents of adder 78 from exceeding the maximum stack count at any given time, the adder test is implemented by a third comparator 126. This comparator will provide a high logic level signal whenever the contents of adder 78 exceed the maximum stack count, and will then cause the contents of adder 78 to be loaded into memory 83. This is accomplished by directing the output of comparator 126 into the load input of memory 83 via OR gate 114 and OR gate 108. This will also cause adder 78 and flip-flop 112 to be reset via OR gate 114 and delay 116.

The circuitry which has thus far been described serves to implement the tests listed previously.

Additional circuitry is provided for loading a signal into memory 83, concurrently with a count signal being loaded therein, which will indicate whether or not that bundle count represents a mixed bundle. This is implemented by directing the end of zip input to comparator 76 into a mixed bundle counter 130. This counter will preferably be a two-bit counter which will count up to, and hold, a count of two (rather than overflowing on the third or a subsequent count). The output of the second bit of counter 130 will be directed to an input to memory 83 and will indicate whether or not a bundle count being loaded therein represents a mixed bundle. If only one end of zip code pulse occurs prior to a load signal, then mixed bundle counter 130 will contain a count of only one, so that the output of the second bit will be zero. This will indicate that the bundle count presently being loaded into memory 83 is unmixed. In the event that two or more end of zip pulses occur between consecutive load signals to memory 83, then the bundle count being loaded into memory 83 upon the arrival of the next load signal will represent a mixed bundle. Since more than one end of zip pulse will have occurred, the output of counter 130 will be at a high logic level, properly indicating that this is a mixed bundle. Mixed bundle counter 130 will be reset by one-shot 132 whenever memory 83 is loaded. This one-shot is included to insure that counter 130 is not reset until after memory 83 has been loaded.

In addition to the foregoing, additional circuitry may be included for preventing the mixed bundling of papers associated with different SCF zones. This may be accomplished, for example, by means of a delay 134 and an AND gate 136. Thus, when an end of zip signal occurs, the circuitry which has thus far been described will operate normally. It will then be desirable to load any remaining count contained within adder 78 into memory 83, so that the next count loaded into memory 83 will include no portion from the previous SCF zone. To this end, a delay 134 will delay the SCF signal until after the comparator circuitry has reached steady state following the end of zip signal. The delayed SCF signal will then be gated through an AND gate 136 whenever the tag on adder 78 indicates that a partial count is contained therein. In this event, the output of AND gate 136 will go to a high logic level, which will produce (by means of OR gate 114) the loading of the contents of adder 78 into memory 83 and the resetting of adder 78.

Memory 83 will load consecutive bundle counts into consecutive memory positions. The load signal supplied to the memory 83 via OR gate 108 may increment an address counter associated with memory 83, which indicates the memory position into which bundle counts are to be loaded. Thus, with each load signal provided by OR gate 108, a bundle count will be loaded into the address identified by the address counter and the address counter will be incremented to the next succeeding value. Memory 83 will also appropriate circuitry for reading out these consecutive bundle counts to the divert, marker and stacker counters.

What is claimed is:

1. A system for applying labels to articles to be mailed, which labels are arranged in zip code groups, some groups being of less than a predetermined minimum number, and for sorting the articles to be mailed into zip code groups comprising:

first conveyor means for conveying the articles in sequence;

label applying means along the conveyor for applying labels of a zip code group in sequence to the articles;

an articles stacker associated with said conveyor for stacking articles delivered thereto;

article diverting means for diverting articles from said stacker;

means for scanning said labels, and means associated with said scanner for storing information as to the zip code grouping of a consecutive number of articles and for controlling said article stacker and diverting means to cause consecutive zip code groups, each of less than the minimum number but together greater than the minimum number to be stacked as a mixed bundle in said stacker.

2. A system as defined in claim 1 further including second conveyor means for receiving said mixed bundle, and conveying it through further processing stations.

3. A method of applying labels to articles, which labels are arranged in zip code groups, some of which are of less than a predetermined minimum number and for sorting the articles into zip code groups comprising the steps of:

conveying the articles in sequence;

applying labels of a zip code group in sequence to the articles being conveyed;

scanning the labels to determine the number of articles in each zip code group;

storing information as to number of articles in the zip code groups;

directing the articles with labels applied thereto to a stacker;

stacking in one bundle articles of a zip code group where the number of articles in the zip code group is greater than the minimum number, and stacking in another mixed bundle articles of consecutive zip code groups in which the number of articles in each of the consecutive zip code groups is less than the predetermined minimum but together the number of articles in the consecutive zip code groups is greater than the predetermined minimum in accordance with the stored information; and diverting from said stacker any zip code group of articles which is less than said minimum and which is not one of said consecutive zip code groups.

4. The method according to claim 3 in which said diverting of articles includes determining the number of articles in each group of identical zip codes, comparing the number of articles in said groups with a preselected minimum, passing said groups having articles equal to and in excess of the preselected minimum, adding the numbers of articles in successive groups each having fewer articles than said minimum, and diverting said groups having fewer articles than the preselected minimum and which cannot be combined with adjacent groups having fewer articles than said minimum to have a total number of articles equal to or greater than said minimum.

5. A system for sorting bulk quantities of articles to be mailed into zip code groups for conveying the articles in sequence comprising first conveyor means, label attaching means along the conveyor for applying labels to the articles, an article stacker for stacking articles conveyed by said conveyor, means for handling the stacks of articles, zip code scanner means sensing zip code information from labels, article diverting means, control means for collecting the information sensed by said scanner means and for instructing said article diverting means to divert consecutive articles forming a zip code group of less than a minimum number from said conveyor means, said control means segregating articles into groups with identical zip codes, said control means deactivating said article diverting means when the number of articles in a group is less than the preselected minimum for more than one adjacent group of articles which together exceed or equal the preselected minimum, and second conveyor means transporting stacked articles from said article stacker to said means for handling the stacked articles.

* * * * *